US006155213A

United States Patent [19]

Tanis

[11] Patent Number: 6,155,213

[45] Date of Patent: Dec. 5, 2000

[54] INTERNAL COMBUSTION ENGINE VENTILATION APPARATUS AND METHOD

[76] Inventor: Peter G. Tanis, R.R. 4, P.O. Box 143, Glenwood, Minn. 56334

[21] Appl. No.: 09/376,544

[22] Filed: Aug. 18, 1999

Related U.S. Application Data

[60] Provisional application No. 60/097,719, Aug. 24, 1998.

[51] Int. Cl.[7] ..... F01M 13/00

[52] U.S. Cl. ..... 123/41.86

[58] Field of Search ..... 123/41.86, 142.5 R, 123/142.5 E, 198 D, 198 P

[56] References Cited

U.S. PATENT DOCUMENTS

| | | |
|---|---|---|
| 1,806,442 | 5/1931 | Bell et al. . |
| 1,844,472 | 2/1932 | Maller . |
| 1,927,554 | 9/1933 | McCleery . |
| 2,022,559 | 11/1935 | Dwyer . |
| 2,646,784 | 7/1953 | McKeever . |
| 2,707,460 | 5/1955 | Horn . |
| 2,808,040 | 10/1957 | Wittren . |
| 2,997,033 | 9/1961 | Holmes . |
| 3,072,112 | 1/1963 | Roper . |
| 3,279,444 | 10/1966 | Leasure . |
| 3,953,707 | 4/1976 | Tanis . |
| 4,213,437 | 7/1980 | Onofrio . |
| 4,245,593 | 1/1981 | Stein . |
| 4,353,332 | 10/1982 | Sweetland . |
| 5,017,758 | 5/1991 | Kirkman et al. . |
| 5,196,673 | 3/1993 | Tanis . |

*Primary Examiner*—Willis R. Wolfe
*Assistant Examiner*—Katrina B. Harris
*Attorney, Agent, or Firm*—Burd, Bartz & Gutenkauf

[57] ABSTRACT

An internal combustion ventilation apparatus and method for reducing the moisture content of an internal combustion engine at rest in order to prevent or minimize corrosive activity in the engine. The apparatus includes the oil filler tube and the engine breather pipe of the engine to be ventilated, as well as a blower. The blower is connected to either the oil filler tube or the engine breather pipe and directed so that air is brought into the engine breather pipe for circulation through the engine cavities, then to be exhausted through the oil filler tube. The dryer outside air displaces moisture laden air in the engine cavities. In one embodiment of the invention an engine preheater is installed on the engine for the purpose of adding heat to the idle engine and increasing the moisture holding capacity of the air being moved through the engine.

18 Claims, 4 Drawing Sheets

INTERNAL COMBUSTION ENGINE VENTILATION APPARATUS AND METHOD

CROSS REFERENCE TO A RELATED APPLICATION

This application derives from Provisional Application Ser. No. 60/097,719 filed Aug. 24, 1998.

FIELD OF THE INVENTION

The invention relates to an apparatus and method for removing moisture laden air from the internal cavities of an internal combustion engine at rest in order to prevent corrosion.

BACKGROUND OF THE INVENTION

Internal combustion engines that are inactive have a tendency to rust internally. This is particularly true for horizontally opposed aircraft engines. Engines that have low operating time since overhaul are particularly susceptible. The corrosion (rust) is the result of having in combination: an exposed metal surface; a corrosive agent such as acid which forms in oil; oxygen; and moisture.

The corrosive agent and oxygen are found in the air and will rust a bare metal surface if it is not protected. When an engine runs it introduces more corrosive agents and moisture into the internal engine cavities. This is the consequence of burning fuel. The corrosive attack can be a direct chemical attack or an electrolysis between two metals with a common electrolyte (moisture).

Moisture is a common component needed for both types of corrosion to occur. Moisture comes from burning fuel such as gasoline. When burned, a pound of fuel will result in a pound of moisture in the exhaust gases. The induction air is also moisture laden which moisture is added to the combustion moisture produced in the cylinder. Some of the moisture goes by the piston rings with "blow-by" and ends up in the crankcase. Another minor source of moisture is moisture laden air that is drawn in through the engine breather as the engine cools after being shut down. As a result of these factors, the resultant humidity in an inactive engine can approach 80% and often reaches 100%.

A small amount of corrosive agent is found in the air. The rest is the result of the combustion process. The corrosive agent can be acid which is formed when oil oxidizes due to long time exposure to heat. It may be sulfur from poor quality crude oil used in the engine, or chlorine compounds found in the air.

Exposed engine surfaces are particularly susceptible to this corrosion. Such surfaces result when the engine is overhauled and everything is cleaned to remove buildups of carbon and oil residue. This also removes the varnish layer which protects parts from rust. When being overhauled, many engine surfaces are freshly ground which exposes bare metal.

SUMMARY OF THE INVENTION

The invention pertains to an apparatus and method for reducing the moisture content of internal cavities of an internal combustion engine at rest by displacing moisture laden air with dryer air. The apparatus includes the oil filler tube and engine breather pipe of the engine as well as a blower connected to one or the other. The blower circulates air through internal spaces of the engine and exhausts it through the oil filler tube. The blower is used while the engine is inactive and with the oil filler tube cap removed.

The circulation of air causes moisture laden air to be exhausted from the engine. This removes one of the common factors in the corrosion process from inside of the engine.

In one form of the invention the engine has an installed engine preheater whereby air is heated internally of the engine. An acceptable preheater is shown in U.S. Pat. No. 3,953,707 to Tanis. The heater is used in conjunction with the air circulating blower which can be attached to the engine breather. With the oil filler cap removed from the oil filler tube, air is circulated through the internal spaces of the engine. The circulating air is warmed due to the action of the preheater. Warming increases the capacity of the air to hold moisture. In addition, heating of the oil sump causes the oil to release entrained moisture which is absorbed by the air and removed from the engine.

In another form of the invention, the apparatus includes a duct that collects air exiting the engine. This air is then passed through an air/moisture separator where the moisture is removed. The air leaving the separator is vented back to the blower intake, creating a closed system. This is advantageous if the engine is located in an environment sensitive to odors and added moisture.

The apparatus can reduce the total relative humidity in the internal spaces of the engine to a value of 15% to 20% after 24 hours of operation.

IN THE DRAWINGS

FIG. 1 is a side view partly in section showing an engine ventilation apparatus according to one form of the invention installed on an internal combustion engine;

DESCRIPTION OF PREFERRED EMBODIMENTS

Figure 7:
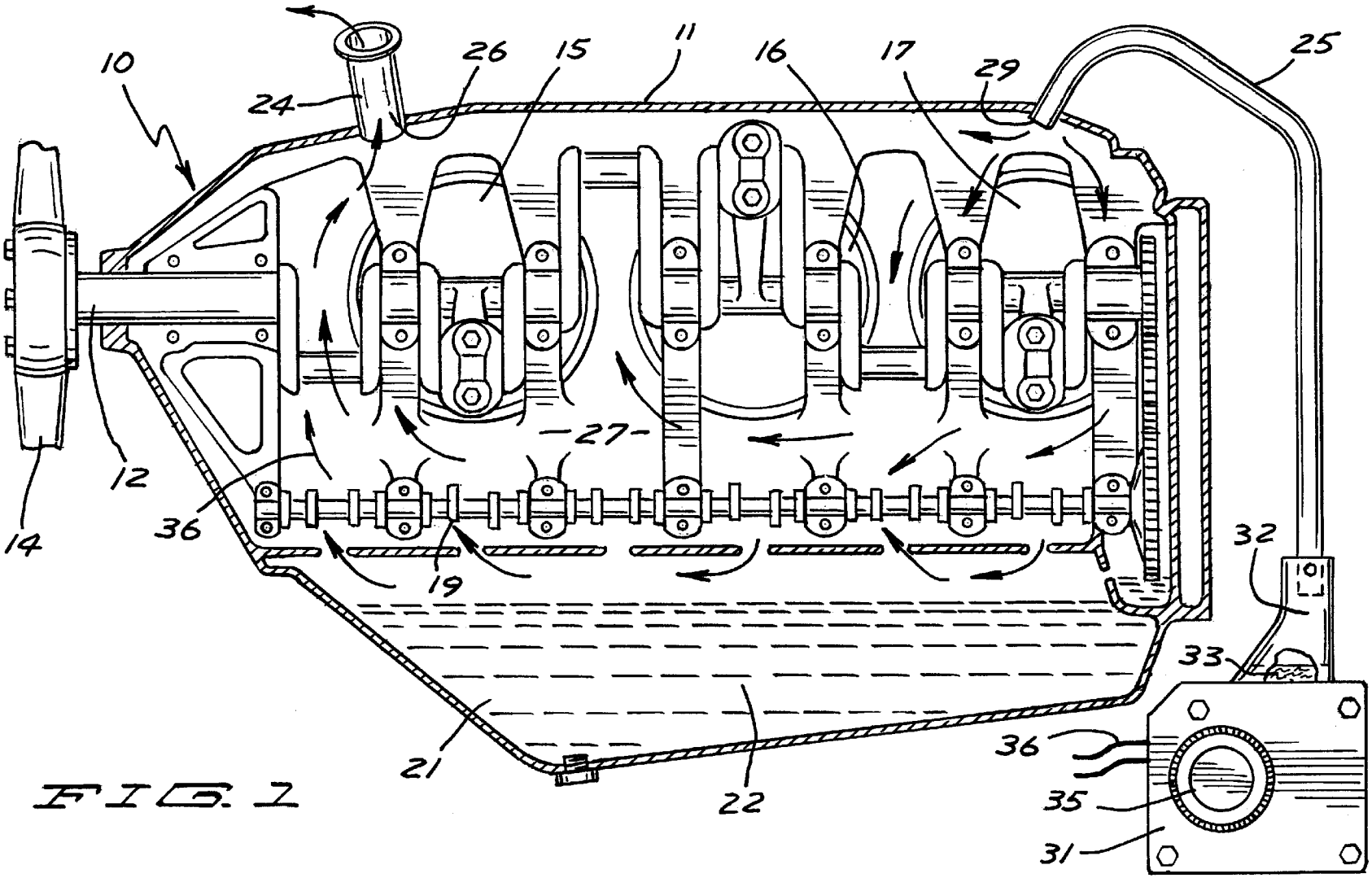

FIG. 1 shows an internal combustion engine, or more particularly an aircraft engine, indicated generally at 10 equipped with an engine ventilation apparatus according to one form of the invention. Engine 10 has an outer housing wall 11 shown cutaway in FIG. 1 for the purpose of illustrating the interior of engine 10 and in particular the internal cavity thereof. A crankshaft 12 extends through engine 10 and extends out of it for connection to a propeller 14. The crankshaft is connected by the usual connection rods to piston assemblies 15, 16 and 17. A cam shaft 19 is operatively connected beneath the piston assemblies. The oil sump 21 is located at the lower portion of the engine housing and contains a supply of oil 22. Engine 10 also has the usual oil filler tube 24 and an engine breather pipe 25. In normal engine operation the oil filler tube is closed by a suitable cap (not shown). As illustrated in FIG. 1, the oil filler tube is open, the cap having been removed. The inside end of oil filler tube 24 opens to the engine at an oil filler tube opening 26. The inside end of the engine breather tube 25 opens to the engine at a breather pipe opening 29.

Engine 10 has an engine cavity 27 defined by engine wall 11 and open throughout the engine an to the various internal engine components. Cavity 27 can be either viewed as a single cavity or a series of interconnected cavities. Either way, engine cavity 27 contains air that can be entrained with moisture while the engine is at rest. This will precipitate corrosion of the engine parts exposed to the moist air which can shorten engine life and lead to other difficulties. The purpose of the invention is to remove unwanted moisture from the engine cavity.

The engine ventilation apparatus of the invention includes the open oil filler tube 24, the engine breather pipe 25 and a blower 31 connected to move air from the breather pipe opening to the oil filler tube opening 26 traversing the internal engine cavity 27 in order to displace the moisture laden air with dryer air.

In the embodiment shown in FIG. 1 the blower 31 is removably connected to the outside end of the breather pipe 25 by a nozzle 32. Blower 31 draws electrical power from any suitable conventional source 36. The electrical source is preferable remote from any vehicle in which the engine is installed so as not to drain power from that source. Blower has a fan 35 directed to draw ambient air and push it through nozzle 32. A filter 33 is positioned to filter air passing into the engine cavity 27.

In use of the invention, when the aircraft engine is at rest the oil filler cap is removed, and the blower is installed and activated. This causes a circulation of outside, dryer air through the engine spaces. The air is preferably filtered by filter 33 as needed according to ambient storage conditions of the engine. The air circulates from the engine breather tube opening through the internal spaces of the engine and out the oil filler tube opening and through the oil filler tube. The oil filler tube is usually located at or near the high point of the engine case. As moist air tends to rise, this facilitates the work of the apparatus. The incoming air indicated by the arrows 36 displaces the resident moisture laded air thus to reduce the moisture content of the environment of the internal cavity of the engine. Use of the apparatus has been found effective to reduce the relative humidity in the open spaces of the engine to a value of 15% to 20% after twenty-four hours. Before starting the engine the nozzle and blower are removed and the oil filler cap is replaced.

Figure 2:
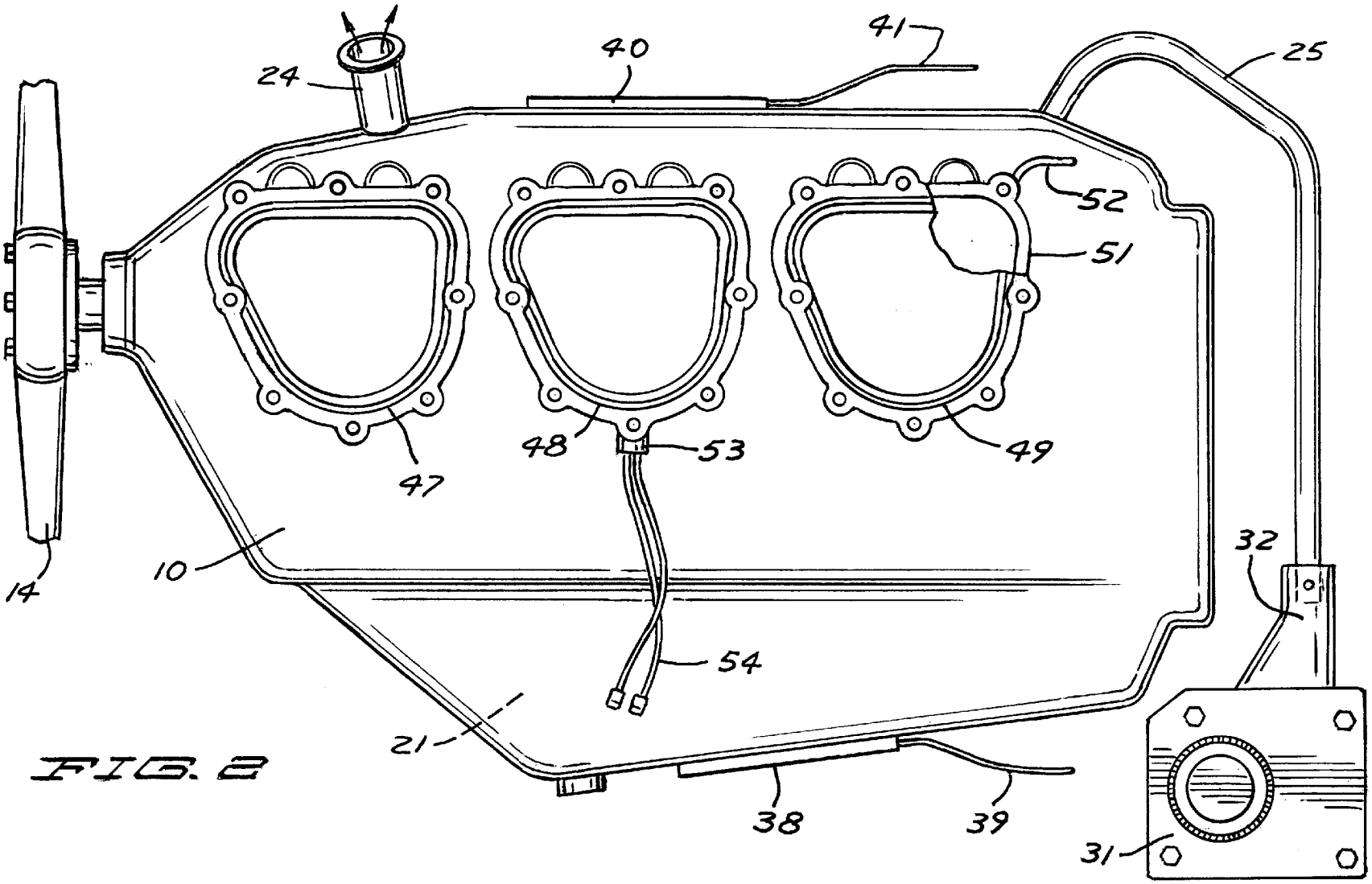
FIG. 2 is a side view of the engine ventilation apparatus according to a modification of the invention installed on an internal combustion engine.

A second form of the invention is shown in FIG. 2. According to this form of the invention, one or more preheaters are installed on the engine. The purpose of the preheater is to increase the moisture carrying capacity of the air. Adding heat to the oil in the engine also causes the oil to release moisture into the local environment which can then be removed.

As show in FIG. 2, the engine 10 is equipped with the open oil filler tube 24, the engine breather pipe 25 and the blower 31 as previously described. In addition the engine is equipped with a number of preheating devices. The particular devices are shown by way of example and not limitation. Other types of preheater devices can be used as well. Acceptable types of preheat devices are shown in U.S. Pat. No. 3,953,707 entitled Method for Preheating Aircooled Aircraft Engines, issued Apr. 27, 1976 to Tanis; U.S. Pat. No. 4,776,529 entitled Helicopter Preheat Assembly, issued Oct. 11, 1988 to Tanis; U.S. Pat. No. 5,196,673 entitled Aircraft Intake Pipe Bolt Heater for Electrically Preheating An Aircraft Engine issued Mar. 23, 1993 to Tanis; U.S. Pat. No. 5,938,963 issued Aug. 17, 1999 and entitled Gasket Shaped Heater; as well as devices shown in references cited in those patents and suitable equivalents. The engine can be equipped with one or more such devices.

By way of example, engine 10 in FIG. 2 is equipped with a first electrical heat pad 38 bonded to the lower portion thereof in the vicinity of the oil sump 21. Heat pad 38 has electrical power leads 39. First heat pad 38 will transfer heat to the oil 22 in sump 21 causing it to release entrained moisture into the environment of cavity 27 for displacement by incoming dry air. A second electrical heat pad 40 is bonded to the upper part of engine 10, having an electric power lead 41.

FIG. 2 shows cylinder heads 47, 48, 49 of engine 10. A gasket shaped heater 51 is installed on a parting surface of the cylinder head 49. Gasket shaped heater 51 has a power lead 52. The gasket shaped heater is of the type described in U.S. Pat. No. 5,938,963 issued Aug. 17, 1999 and entitled Gasket Shaped Heater.

A probe type preheater 53 is installed adjacent cylinder head 48 and has a power lead 54. Preheater 53 is can be constructed in accordance with the teachings of U.S. Pat. No. 3,953,707.

In the use of the ventilating apparatus of FIG. 2, a preheating device is energized when the engine is not operating. The oil filler cap is removed. Blower 31 is installed and operated. Operation of the heater increases the moisture holding capacity of the air in the engine cavity and causes release of moisture that might be entrained in the oil. The moisture laden air is displaced by the dryer air introduced into the engine cavity by the blower. At the same time the preheat device will facilitate engine start up upon the next use of the aircraft.

Figure 3:
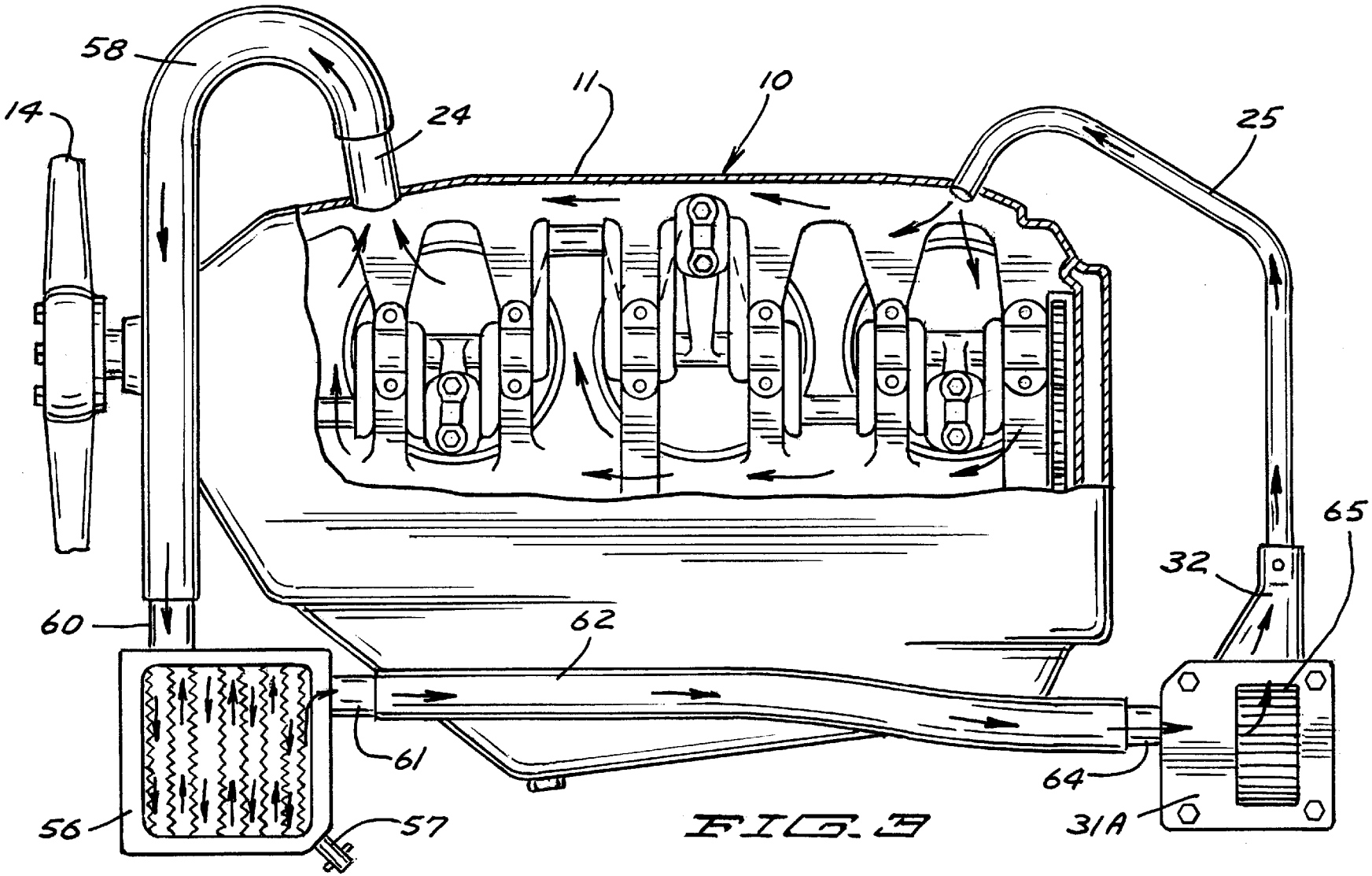
FIG. 3 is a side view partly in section showing an engine ventilation apparatus according to a yet further form of the invention installed on an internal combustion engine.

In the form of the invention shown in FIG. 3 the apparatus uses a duct that collects moist air exiting the engine. Moisture is extracted from the air for recirculation through the engine to absorb additional moisture. This is particularly advantageous when the engine 10 is stored in a humid or dirty or dusty environment. FIG. 3 once again shows engine 10 having oil filler tube 24 and a blower 31A. An air/moisture separator assembly includes a moisture separator 56 disposed in line between the oil filler tube 24 and an inlet to the blower 31A. An outlet duct or hose 58 is connected at one end to the outside end of oil filler tube 24. The opposite end of outlet duct 58 is connected to the inlet fitting 60 of moisture separator 56. Moisture separator 56 is of any convenient and known variety adapted to separate moisture from incoming air received through inlet fitting 60. Moisture separator 56 has a drain valve 57 for release of moisture separated from the air. A return duct 62 is connected at one end to an outlet fitting 61 of the moisture separator 56. The other end of return duct 62 is connected to an inlet fitting 64 of blower 31A. The apparatus is attached when engine 10 is not in use. The fan 65 of blower 31A circulates air through the engine cavity 27 of engine 10 and out oil filler tube 24. The exhausted, moisture laden air travels through outlet duct 58 to the moisture separator 56. Moisture is removed from the moisture laden air by the moisture separator 56. The dryer air moves through the return duct 62 back to the blower 31A. In the process the air does not pick up moisture or contaminants from the environment surrounding the engine and introduce them into the engine.

Figure 4:
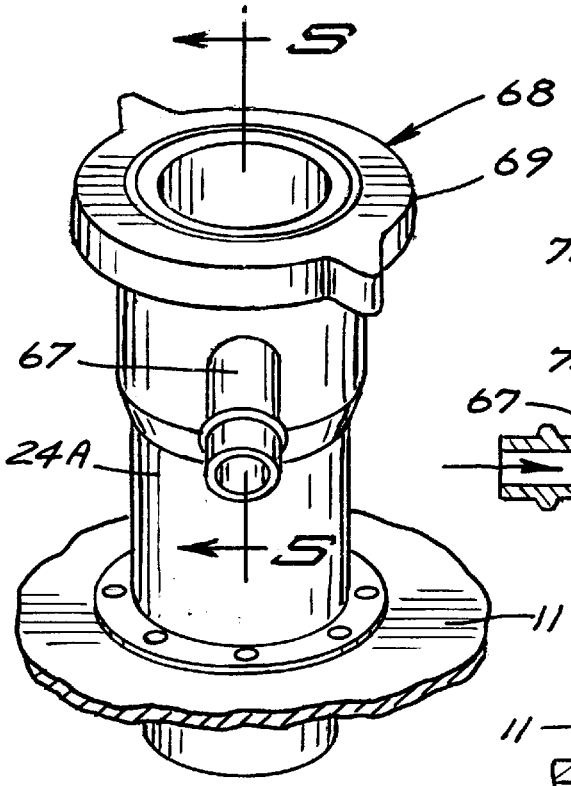
FIG. 4 shows another form of the invention wherein the engine breather pipe and the oil filler tube of the engine are coaxial.
Figure 5:
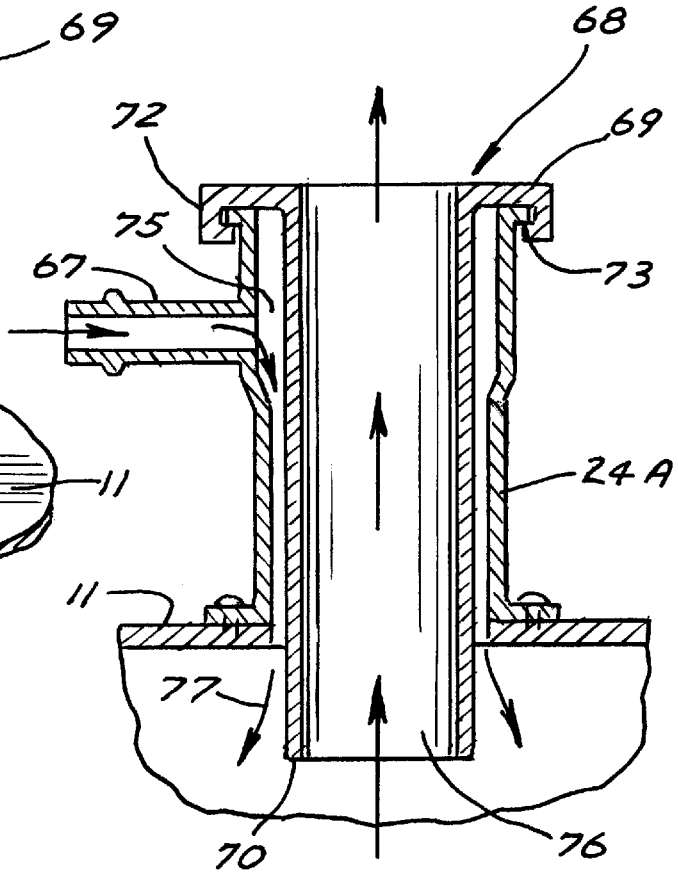
FIG. 5 is a sectional view of the apparatus of FIG. 4 taken along the line 5—5 thereof.

Certain engines have the engine breather pipe integral with the oil filler tube. FIGS. 4 and 5 illustrate a modification of the invention for use with such engines. An oil filler tube 24A is fixed to the engine wall 11. An engine breather pipe intersects the oil filler tube 24A. An adaptor 68 is installed on and in the oil filler tube when the engine is at rest and the normal oil filler cap is removed. Adapter 68 has a cap 69 and a tubular barrel section 70. Barrel section 70 can be flexible. Cap 69 surrounds the upper end of barrel section 70 and engages the top of the oil filler tube 24A. Barrel section 70 extends down into the oil filler tube into the engine cavity 27. Cap 69 has an inwardly flanged connector 72. The outside end of oil filler tube has an outwardly extended lip that normally connects with the oil filler tube cap when the engine is in operation. The cap 69 mimics the normal oil filler tube cap. The flanged connector 72 engages the lip 73 to securely connect the adapter 68 to the oil filler tube 24A.

The barrel section 70 is inwardly spaced from the inner surface of the oil filler tube forming a first air passage 75. The interior of barrel section 70 forms a second air passage 76. Breather pipe 67 is connected to a blower (not shown). The blower is operated to move dry ambient air into the engine cavity 27 by moving it through the engine breather pipe 67 and down the first air passage 75 as indicated by the arrows 77. The air circulates through the engine cavity and displaces the moister air therein. The moisture laden air is exhausted through the second passage 76 of the adapter 68.

Figure 6:
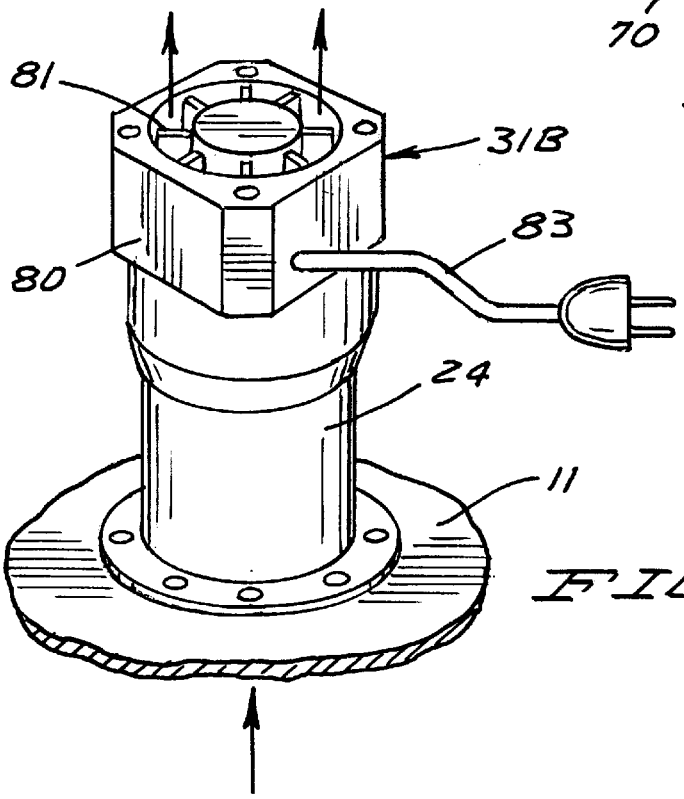
FIG. 6 is a perspective view of a portion of a modification of the invention.

FIG. 6 depicts a modification of the invention wherein a blower is mounted on the oil filler tube in such a manner as to pull air through the engine cavity from the outside end of the breather pipe. A blower 31B is mounted on the outside end of the oil filler tube 24. The blower 31B has a housing 80 that removably fits in snug relationship over the top of oil filler tube 24 when the engine is at rest and the normal oil filler cap is removed. Housing 80 contains a fan assembly 81 oriented to direct air flow outward of the oil filler tube 24. A power cord 83 supplies power to run the fan assembly 81. This embodiment of the invention operates like that shown in FIG. 1 with the exception of the location of the blower. Dryer ambient air is drawn through the breather pipe and through the engine cavity. This displaces moister air which is moved out through the oil filler tube under the influence of blower 31B. Prior to use of the engine the blower 31B is removed and the normal oil filler cap is replaced.

In terms of a method of reducing the moisture content of the internal cavities of an internal combustion engine, the oil filler cap of the engine is removed while the engine is at rest, so that the oil filler tube is open. The engine breather pipe is open. A blower is connected to either the engine breather pipe or the oil filler tube. The blower is directed so that air will be moved from the engine breather pipe through the engine cavities and out of the oil filler tube. A preheater device can be used to add heat to the air in the engine cavities. An air/moisture separator can be use to make a closed system.

The embodiments of the invention in which an exclusive property or privilege is claimed are defined as follows:

1. An internal combustion engine ventilation apparatus for reducing the moisture content of air in an internal combustion engine at rest, comprising:

an oil filler tube having an inside end connected to an internal combustion engine to be ventilated and open to internal cavities thereof, with the oil filler cap removed so that the outside end of the oil filler tube is open to the environment surrounding the engine;

an engine breather pipe having an inside end connected to the engine and open to internal cavities thereof, the outside end of the engine breather pipe being open;

at least one engine preheater installed on the engine at a location to add heat to air in the engine cavities in order to increase the moisture holding capacity of the air in the engine cavities;

a blower connected to the outside end of the breather pipe directed to blow air into the breather pipe from the external environment so that air will circulate through the internal cavities of the engine and exhaust through the oil filler tube, said blower being electrically powered and connectable to an electrical source remote from the internal combustion engine.

2. The engine ventilation apparatus of claim 1 wherein:

the engine preheater includes a gasket type preheater installed on a parting surface of the engine.

3. The engine ventilation apparatus of claim 2 wherein:

the engine preheater is a pad type preheater installed on a wall of the engine.

4. The engine ventilation apparatus of claim 2 wherein:

the engine preheater is a probe type preheater installed in the engine wall.

5. The engine ventilation apparatus of claim 1 including:

a plurality of preheaters installed on the engine for the purpose of adding heat to the engine cavities while the blower is operated.

6. An internal combustion engine ventilation apparatus for reducing the moisture content of air in an internal combustion engine at rest, comprising:

an oil filler tube having an inside end connected to an internal combustion engine to be ventilated and open to internal cavities thereof, with the oil filler cap removed so that the outside end of the oil filler tube is open to the environment surrounding the engine;

an engine breather pipe having an inside end connected to the engine and open to internal cavities thereof, the outside end of the engine breather pipe being open;

a blower connected to the outside end of the breather pipe directed to blow air into the breather pipe from the external environment so that air will circulate through the internal cavities of the engine and exhaust through the oil filler tube, said blower being electrically powered and connectable to an electrical source remote from the internal combustion engine;

said breather pipe intersecting the oil filler tube;

an adapter installed in the oil filler tube, said adapter having a tubular barrel section and a cap connected at one end to the tubular barrel section;

said cap releasably connected to the outside end of the oil filler tube so that the barrel section extends through the oil filler tube into the engine cavity;

said barrel section of a dimension so that it is spaced from the inside wall of the oil filler tube providing an inlet passage for air from the breather pipe between the inside surface of the oil filler tube and the barrel section, and an outlet for air from the engine cavity through the tubular barrel section.

7. The engine ventilation apparatus of claim 6 including:

at least one engine preheater installed on the engine for the purpose of adding heat to the engine cavities while the blower is operated.

8. The engine ventilation apparatus of claim 7 wherein:

the engine preheater is a gasket type preheater installed on a parting surface of the engine.

9. The engine ventilation apparatus of claim 7 wherein:

the engine preheater is a pad type preheater installed on a wall of the engine.

10. The engine ventilation apparatus of claim 7 wherein:

the engine preheater is a probe type preheater installed in the engine wall.

11. An internal combustion engine ventilation apparatus for removal of moisture laden air from an internal combustion engine at rest, comprising:

an oil filler tube connected at an inside end to an internal combustion engine to be ventilated and open to internal cavities thereof, with the oil filler cap removed so that the outside end of the oil filler tube is open to the environment surrounding the engine;

an engine breather pipe connected at an inside end to the engine and open to internal cavities thereof, the outside end of the breather pipe being open;

a blower connected to the outside end of the oil filler tube directed to move air out of the oil filler tube from the engine cavities so that air will be drawn into the engine cavities through the breather pipe and circulate through the engine cavities to be exhausted through the oil filler tube, said blower being electrically powered and connectable to an electrical source remote from the internal combustion engine.

12. The engine ventilation apparatus of claim 11 including:

at least one engine preheater installed on the engine for the purpose of adding heat to the engine cavities while the blower is operated.

13. The engine ventilation apparatus of claim 12 wherein:

the engine preheater includes a gasket type preheater installed on a parting surface of the engine.

14. The engine ventilation apparatus of claim 12 wherein:

the engine preheater includes a pad type preheater installed on a wall of the engine.

15. A method of reducing the moisture content of the internal cavities of an internal combustion engine at rest, said engine having an oil filler tube normally closed by an oil filler tube cap, and an engine breather pipe in communication with the oil filler tube through the engine cavities, comprising the steps of:

removing the oil filler tube cap from the oil filler tube so that the oil filler tube is open;

using an engine preheater device to heat air located in the internal cavities of the engine;

using an electrically operated blower to circulate air from outside of the engine, into the engine through the engine breather pipe and exhausting the air through the oil filler tube.

16. The method of reducing the moisture content of the internal cavities of an internal combustion engine of claim 15 wherein:

the step of using a blower includes connecting a blower to the engine breather pipe in a direction to move air from outside of the engine into the engine through the engine breather pipe to be exhausted through the oil filler tube.

17. A method of reducing the moisture content of the internal cavities of an internal combustion engine at rest, said engine having an oil filler tube normally closed by an oil filler tube cap, and an engine breather pipe in communication with the oil filler tube through the engine cavities, comprising the steps of:

removing the oil filler tube cap from the oil filler tube so that the oil filler tube is open;

using an electrically operated blower to circulate air from outside of the engine, into the engine through the engine breather pipe and exhausting the air through the oil filler tube;

recirculating air exhausted from the oil filler tube through a moisture separator and back to the blower.

18. The method of reducing the moisture content of the internal cavities of an internal combustion engine of claim 15 wherein:

the step of using a blower includes connecting a blower to the oil filler tube in a direction to draw air from the engine through the oil filler tube.

* * * * *